US009211577B2

(12) United States Patent
Adolphy et al.

(10) Patent No.: US 9,211,577 B2
(45) Date of Patent: Dec. 15, 2015

(54) EXTRUSION PRESS FOR MAKING PROFILES OF NONFERROUS METAL

(75) Inventors: Dirk Adolphy, Mettmann (DE); Georg Glass, Grevenbroich (DE); Peter Heinen, Duisburg (DE)

(73) Assignee: SMS MEER GMBH, Moenchengladbach (DE)

( * ) Notice: Subject to any disclaimer, the term of this patent is extended or adjusted under 35 U.S.C. 154(b) by 1152 days.

(21) Appl. No.: 13/027,303

(22) Filed: Feb. 15, 2011

(65) Prior Publication Data

US 2011/0203345 A1 Aug. 25, 2011

(30) Foreign Application Priority Data

Feb. 25, 2010 (DE) ..... 10 2010 009 365
Jan. 28, 2011 (DE) ..... 10 2011 009 689

(51) Int. Cl.
*B21C 23/21* (2006.01)
*B21C 31/00* (2006.01)

(52) U.S. Cl.
CPC ..... *B21C 23/211* (2013.01); *B21C 31/00* (2013.01)

(58) Field of Classification Search
CPC ..... B21C 23/211; B21C 31/00
USPC ..... 72/28.1, 29.2, 273.5, 453.02, 453.01, 72/453.18, 271, 253.1
See application file for complete search history.

(56) References Cited

U.S. PATENT DOCUMENTS 2,931,497 A * 4/1960 Billen ..... 72/60
5,325,694 A * 7/1994 Jenista ..... 72/271
6,163,129 A 12/2000 Younger et al.
6,426,874 B2 * 7/2002 Kajiura ..... 361/700
6,621,742 B1 9/2003 Yamada
6,912,849 B2 * 7/2005 Inoue et al. ..... 60/475
8,011,219 B2 * 9/2011 Hagen et al. ..... 72/253.1
2009/0121670 A1 * 5/2009 Brand ..... 318/778
2011/0203345 A1 8/2011 Adolphy et al.

FOREIGN PATENT DOCUMENTS

EP 2000226 A 12/2008
EP 2000226 B1 † 10/2009
JP 614571 A † 1/1994
JP 81233 A † 1/1996
JP 20023699563 A 12/2002
JP 2007322660 A 12/2007
JP 2009022993 A 2/2009
JP 2009303323 A † 12/2009
KR 2007013553 A * 1/2007

OTHER PUBLICATIONS

RU 248006 published Dec. 10, 1984.*
Allen-Bradley A Rockwell International Company, Applications Manual, SMC PLUSTM Smart Motor Controller, Bulletin 150, Jun. 1989, p. 1-1, 1-2, 3-1, 3-2, 7-15, 8-28, 8-29.†

* cited by examiner
† cited by third party

*Primary Examiner* — Shelley Self
*Assistant Examiner* — Pradeep C Battula
(74) *Attorney, Agent, or Firm* — Andrew Wilford

(57) ABSTRACT

An extrusion press for making profiles of nonferrous metal has a ram, a hydraulic piston/cylinder assembly for moving the ram, a pump connected to the assembly for pressurizing same, and an electric motor connected to the pump for driving same. A multiphase source of electricity is connected via a controller to the electric motor for a soft start of the motor.

9 Claims, 4 Drawing Sheets

EXTRUSION PRESS FOR MAKING PROFILES OF NONFERROUS METAL

FIELD OF THE INVENTION

The present invention relates to an extrusion press for making profiles of nonferrous metal. More particularly this invention concerns a system for powering such a press.

BACKGROUND OF THE INVENTION

A typical extrusion press for making profiles of nonferrous metal has at least one ram driven by at least one piston/cylinder actuator in turn supplied with hydraulic fluid under pressure by at least one pump. This pump is driven by an electric motor connected to a multiphase line or power source.

Such an extrusion press is known from EP 2 000 226. Here, a three-phase asynchronous motor is used to drive the pump. For a soft start-up of such powerful motors, such as in particular three-phase motors, it is known to hook them up in a star-delta connection. The star-delta connection is used to limit the starting current of an asynchronous motor in delta connection. Here, the motor is brought to speed in the star connection. When switching over, theoretically, only the delta current is necessary to get to the nominal speed. Thus, the starting current is reduced to a third the current in a direct start-up in delta connection. However, when switching from star to delta connection, the phases of the line current and the motor field can be in opposition to each other. This results in equalization processes that disadvantageously lead to very high peak switch currents.

In particular, when using the star-delta switching and a fault-voltage protection switch, it is not possible or only limitedly possible to run a cyclical pump switching circuit in an energy-efficient manner.

As is the case for fault-voltage protection switches integrated in the motor control, a frequent switching off is afflicted with problems or even impossible. This is the reason why in generic plants, the pumps that are not needed run is continuously because their motors cannot be switched off. This results in energy-related disadvantages because the pumps are operated to a greater extent than it is necessary for carrying out the pressing process.

OBJECTS OF THE INVENTION

It is therefore an object of the present invention to provide an improved extrusion press for making profiles of nonferrous metal.

Another object is the provision of such an improved extrusion press for making profiles of nonferrous metal that overcomes the above-given disadvantages, in particular that, on the one hand, it is possible to achieve a problem-free start-up of the system but also, on the other, to run at the same time an energy-efficient operational mode and in particular to operate the motors for driving the pump only to the extent required for the current pressing job.

SUMMARY OF THE INVENTION

An extrusion press for making profiles of nonferrous metal has according to the invention a ram, a hydraulic piston/cylinder assembly for moving the ram, a pump connected to the assembly for pressurizing same, and an electric motor connected to the pump for driving same. A multiphase source of electricity is connected via a controller to the electric motor for a soft start of the motor.

The controller has in particular at least two thyristors or triacs for phase control of at least two of the three phases of the alternating current voltage. However, it is also possible to provide three thyristors or triacs to cut all three phases of a three-phase alternating current voltage.

The electric motor is in particular an asynchronous motor.

One pump can supply two or more piston/cylinder actuators with hydraulic fluid. However, it is also possible that a plurality of pumps supply at least one hydraulic piston/cylinder actuator with hydraulic fluid via communicating fluid lines. In the latter case the several pumps supply at least two hydraulic piston/cylinder actuators with hydraulic fluid via the communicating fluid lines.

In general, with the soft start used according to the invention, measures for power limitation when switching on an electrical device, here an electric motor, are described. Here, on the one hand, the starting current of the device under load is reduced, i.e. the starting current is limited. In case of high loads, thus, the tripping of a line circuit breaker or a major voltage dip is prevented. On the other hand, the components driven by the electric motor are protected against excessively high torques and accelerations.

To limit starting current, thyristors or triacs that function by phase clipping are used. At switch-on, the thyristors or triacs reduce the voltage by such phase clipping. Subsequently, the phase clipping can be reduced until the full supply voltage is reached. When reaching the full voltage, the electronics can be bridged by a relay or switch to reduce power losses This way, start-up even at rated load is made possible.

The problematic start-up of the system and a potentially excessively high energy consumption can thus be prevented according to the invention in that the motor control is equipped with a soft starter. Furthermore, in a simple manner pumps not needed can be switched off in short cycles. It has to be taken into account here that for a majority of the normal production, pressing times are longer than 90 seconds. With the proposed solution it is possible, without high peak loads and in an energy-efficient manner, to run any number of load cycles, the pumps being switched on at different times. This results in a high energy saving potential that can be used with the invention.

The variable pump switch-off rules out that pumps produce only waste heat. The associated risk increases without the use of the invention at the same rate as the size of the press increases.

The configuration according to the invention is characterized by simple technology that is available and fully developed.

The pumps that are not needed during the pressing process can be switched off in a simple manner. This can take place in particular in case of pressing times longer than 90 seconds that, as already mentioned, corresponds to most production cycles. Short cycles can also be run in an energy-efficient manner.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one FIG. but identical to those of another refer to structure that is functionally if not structurally identical. In the accompanying drawing.

SPECIFIC DESCRIPTION

Figure 1:
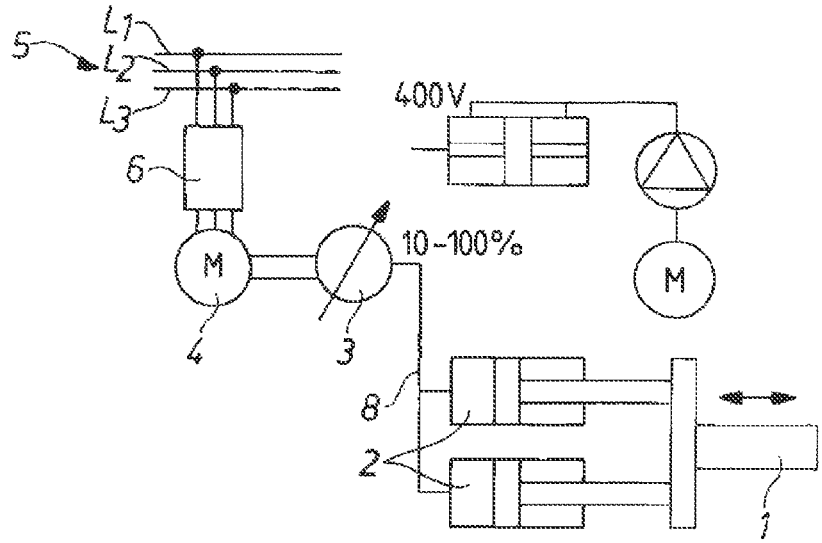
FIG. 1 is a schematic diagram of the drive of an extrusion press for producing profiles made of nonferrous metal according to a first embodiment of the invention.

FIG. 1 shows a ram 1 of an extrusion press for producing profiles made of nonferrous metals. The ram 1 is shifted axially by two double-acting (see arrow FIG. 1) hydraulic piston/cylinder actuators 2. The hydraulic piston/cylinder actuators 2 receive pressurized hydraulic fluid from a pump 3 via a conduit or feed line 8. The pump 3 in turn is driven by an electric motor 4. The electric motor 4 in turn is electrically connected to a network 5 having three phases $L_1$, $L_2$ and $L_3$. Between the three-phase network 5 and the electric motor 4, an electronic controller or control means 6 is provided that is setup according to the invention for soft starting.

Figure 2:
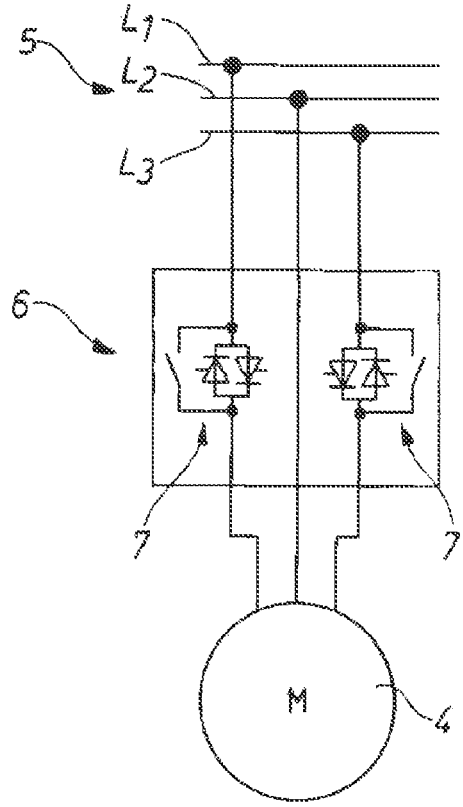
FIG. 2 is a detail view of the electric motor of the drive according to FIG. 1.

The controller 6 for soft starting is shown in more detail in FIG. 2. It has for two of the phases, namely the phases L1 and L3, a bidirectional thyristors or triacs 7. The mode of operation of the two triacs 7 is shown in the FIGS. 3*a* to 3*c*.

Figure 3A:
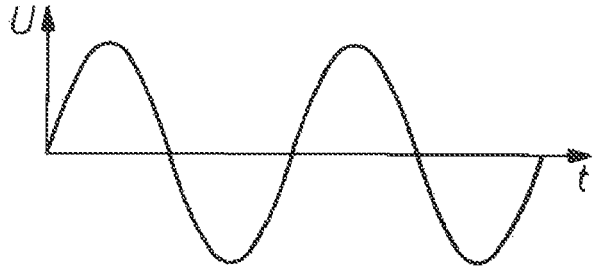
FIG. 3*a* is a graph of the voltage of a three-phase network plotted with respect to time.

In FIG. 3*a*, the initial unaffected sine curve of the voltage U of a phase is plotted over time t. This voltage curve corresponds to full power and is supplied to the electric motor 4 when the motor runs and has to deliver maximum power.

During start-up of the electric motor 4 and also when the motor has to be stopped, the phase of the voltage curve U is cut. Accordingly, the power is transmitted from the mains to the electric motor 4 only when the triacs 7 is triggered. The points in time t at which this takes place in each case periodically are indicated with the arrows 9 that show the trigger sites in FIGS. 3*b* and 3*c*. Accordingly, only the regions drawn with solid lines represent electrical energy supplied to the electric motor 4 from the three-phase network 5. The dashed-line curves, in contrast, identify the time during which the electric motor 4 is not supplied with energy because triacs ignition has not yet taken place.

Figure 3B:
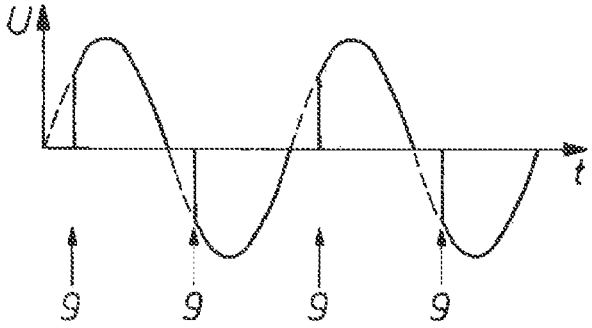
FIG. 3*b* is a graph showing the phase-cut voltage of the instant invention.
Figure 3C:
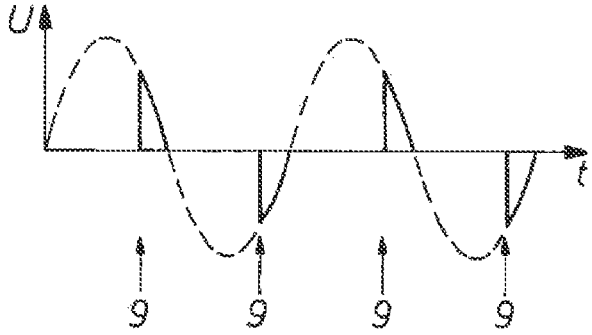
FIG. 3*c* is a graph like FIG. 3*b* but with a more shows the curve with a greater cut-off of the phase according to FIG. 3*a;*

A comparison of the FIGS. 3*b* and 3*c* shows that the timing of the triggering determines how much energy is passed from the three-phase supply 5 to the electric motor 4. In FIG. 3*b*, more energy is passed than in the case of a later ignition according to FIG. 3*c*.

Figure 4:
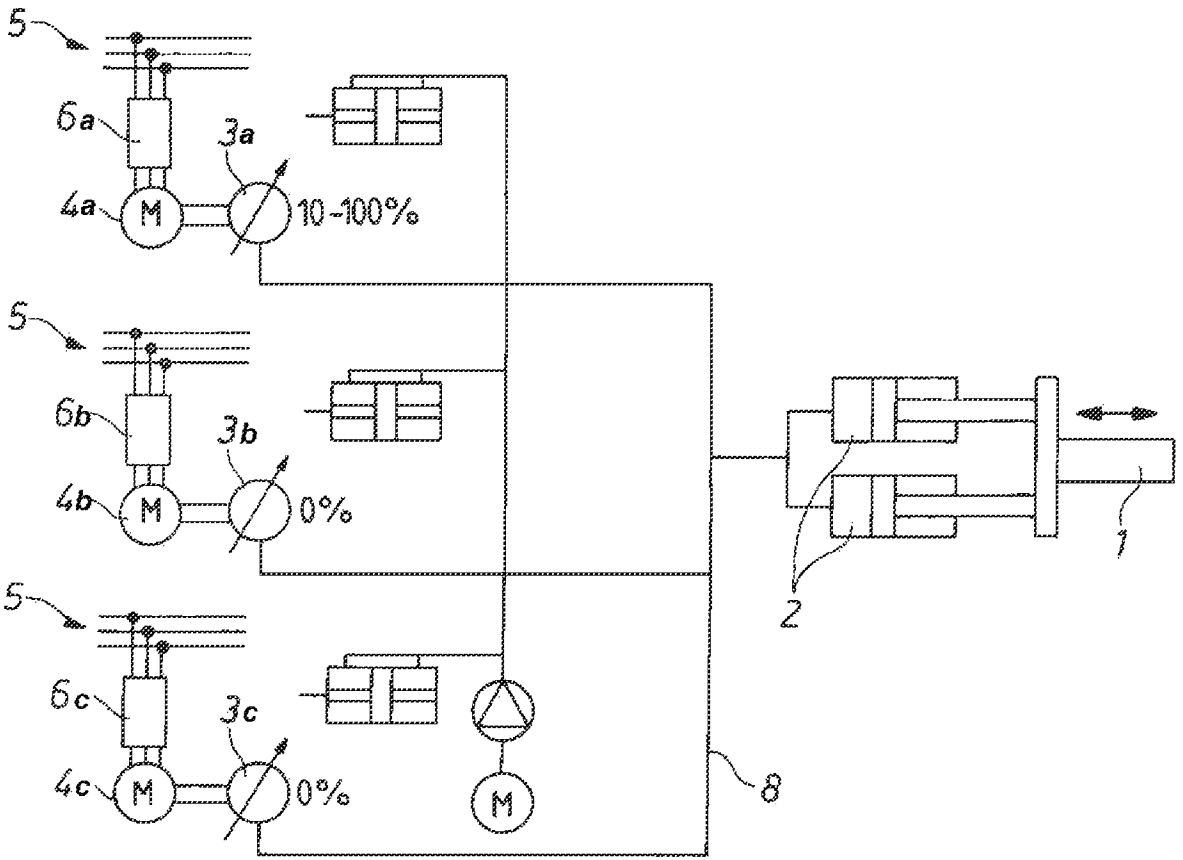
FIG. 4 is a schematic diagram of another drive/power system for an extrusion press for producing profiles made of nonferrous metals according to a second embodiment of the invention.

FIG. 4 shows that three electric motors 4*a-c* operated by respective controllers 6*a-c* to work in parallel to supply pressurized fluid from respective pumps 3*a-c* via the fluid line 8 to two hydraulic piston/cylinder actuators 2 also connected in parallel.

According to the invention it is possible to control the supplied power over a wide range. An example of this is shown in FIG. 4 where with no gate voltage (indicated in FIG. 4 at 0%) applied to the triacs of the controllers 6*b* and 6*c* of the middle and lower electric motors 4*b* and 4*c*, no energy at all is supplied to these motors 4*b* and 4*c* and they do not drive the respective pumps 3*b* and 3*c*. On the other hand, the upper controller 6*a* is operating with the respective triac at least partially triggered (indicated in FIG. 4 with 10-100%) and accordingly, energy is supplied to the upper electric motor 4*a* and the respective pump 3*a* is driven. Thus FIG. 4 shows a system wherein only a single one of the three pumps 3*a-c* is used, when for instance the power needed to operate the ram 1 is low. When a more difficult to extrude workpiece is being made, two or all three of the pumps 3*a-c* can be used. The advantage is of course that it is possible to completely shut down part of the hydraulic system powering the actuators 2 when only limited power is needed. The system can also even be operated when one of the pumps, motors, or controllers is down or being serviced.

Figure 5:
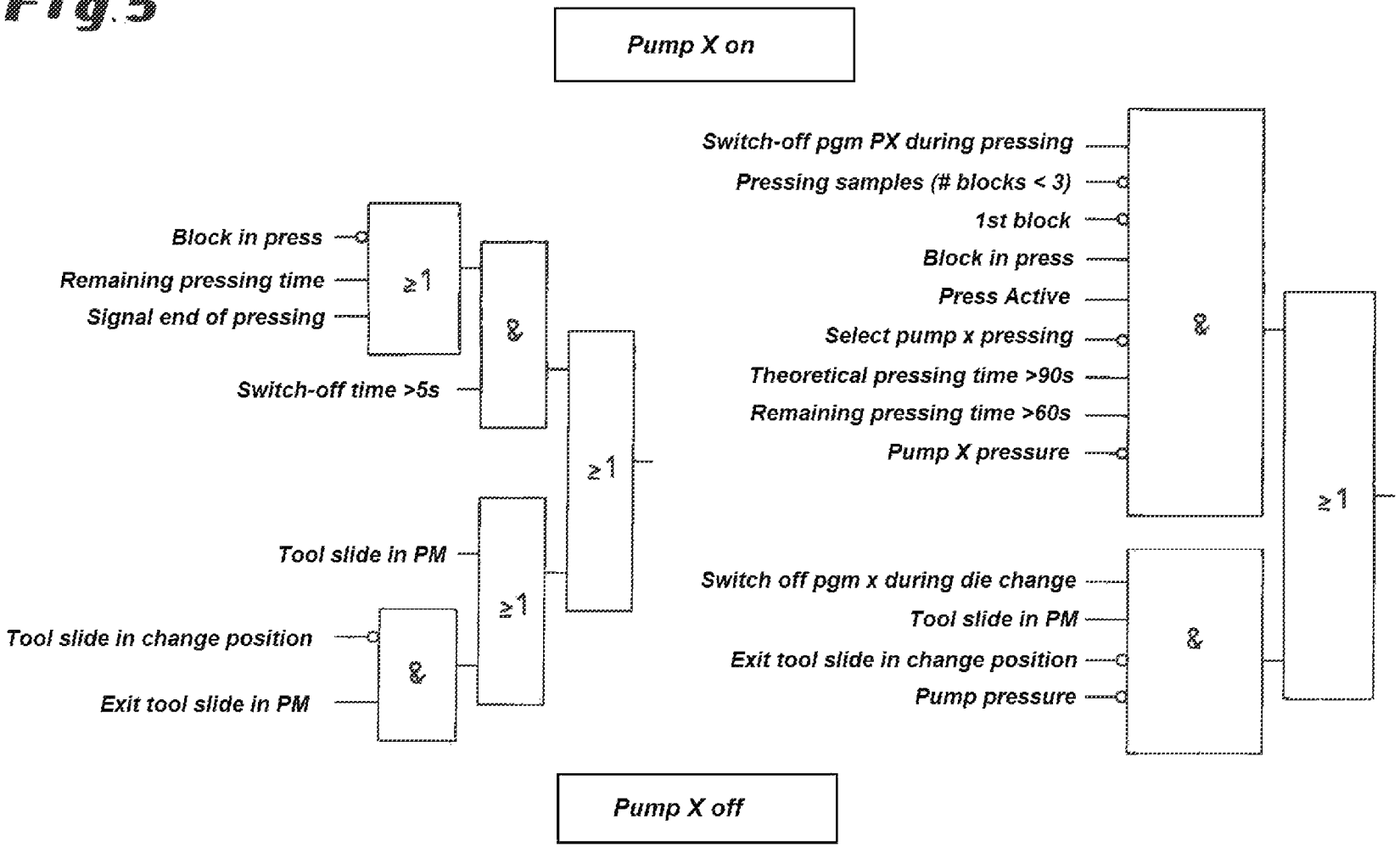
FIG. 5 is a block diagram of a pump switch-off with a soft starter.

FIG. 5 illustrates very schematically that between an upper state ("pump X switched on") and a lower state ("pump X off"), an action by the controller 6 for soft starting can take place in order to start-up the electric motor or to ramp it down.

Thus, the pumps can be operated in an advantageous manner according to need. For example, the pumps start only for a block change or depending on the pressing speed to be achieved.

Retrofitting the proposed system according to the invention is simple because the electric motor does not have to be suitable for fault-voltage protection. Power cables can be used without shield. Furthermore, only a small space is required in the control cabinet.

We claim:

1. An extrusion press for making profiles of nonferrous metal, the press comprising:

a ram;

a hydraulic piston/cylinder assembly for moving the ram;

a pump connected to the assembly for pressurizing same;

an electric motor connected to the pump for driving same;

a multiphase source of electricity;

a bidirectional thyristor connected between the source and the electric motor and control means connected to the bidirectional thyristor for a soft start of the motor by phase control of the multiphase electricity from the source.

2. The extrusion press defined in claim 1 wherein there are at least two bidirectional thyristors each connected to a respective phase of the electricity of the source.

3. The extrusion press defined in claim 2 wherein there are three phases and each has a respective one of the bidirectional thyristors.

4. The extrusion press defined in claim 1 wherein the motor is an asynchronous motor.

5. The extrusion press defined in claim 1 wherein there are at least two such hydraulic/piston assemblies connected between the pump and the ram.

6. The extrusion press defined in claim 1 wherein there are a plurality of the pumps all connected to the ram and each having a respective motor and control means.

7. The extrusion press defined in claim 6 wherein there are at least two such hydraulic/piston assemblies connected between the pumps and the ram.

8. An extrusion press for making profiles of nonferrous metal, the press comprising:

a ram;

a hydraulic piston/cylinder assembly for moving the ram;

a three-phase voltage source;

three respective pumps connected to the assembly for pressurizing same;

three respective electric motor connected to the pumps for driving same;

three respective independently operable triacs connected between the source and the electric motors; and control means connected to the triacs for individual control of the motors by phase control of the multiphase electricity from the source.

9. An extrusion press for making profiles of nonferrous metal, the press comprising:

a ram;

a hydraulic piston/cylinder assembly for moving the ram;

a pump connected to the assembly for pressurizing same;

an electric motor connected to the pump for driving same;

a multiphase source of electricity;

thyristors connected between the source and the electric motor for phase control of the multiphase electricity from the source;

respective bypass switches each connected across a respective one of the thyristors and closable for passing current past the respective thyristors; and means for operating the thyristors and switches by opening the switches at startup for a soft start of the motor and for closing the switches thereafter during normal operation of the motor.

* * * * *